US006113487A

United States Patent [19]

Kim

[11] Patent Number: 6,113,487

[45] Date of Patent: Sep. 5, 2000

[54] AIR-FLOW DIRECTION-CONTROL APPARATUS OF A WINDOW TYPE AIR CONDITIONER

[75] Inventor: Chang-Ki Kim, Incheon, Rep. of Korea

[73] Assignee: Daewoo Electronics Co., Ltd., Seoul, Rep. of Korea

[21] Appl. No.: 09/133,383

[22] Filed: Aug. 13, 1998

[30] Foreign Application Priority Data

May 22, 1998 [KR] Rep. of Korea ..... 98-8584

[51] Int. Cl.[7] ..... F24F 13/15

[52] U.S. Cl. ..... 454/202; 454/313; 454/314; 454/319

[58] Field of Search ..... 454/155, 202, 454/313, 314, 315, 319, 321

[56] References Cited

U.S. PATENT DOCUMENTS

| | | | |
|---|---|---|---|
| 3,472,149 | 10/1969 | Harrison | 454/202 |
| 3,735,691 | 5/1973 | Gofton et al. | 454/155 X |
| 4,702,156 | 10/1987 | Sano . | |
| 5,046,406 | 9/1991 | Harris et al. | 454/202 X |
| 5,338,252 | 8/1994 | Bowler et al. | 454/155 |
| 5,482,506 | 1/1996 | Tsuda et al. | 454/155 |
| 5,676,438 | 10/1997 | Jeong . | |

FOREIGN PATENT DOCUMENTS

| | | | |
|---|---|---|---|
| 61-128059 | 6/1986 | Japan | 454/155 |

*Primary Examiner*—Harold Joyce
*Attorney, Agent, or Firm*—Pillsbury Madison & Sutro LLP

[57] ABSTRACT

Air conditioner which can adjust a direction of an air-flow being discharged into a room. The air conditioner has blades for controlling the air flow direction and a connecting bar for connecting the blades such that the blades rotate together. The blades and the connecting bar can be reassembled. The air conditioner can adjust the flow direction of the air discharged from the air conditioner, thereby uniformly conditioning the inside of a room. In addition, even if hinge bars which connect the blades and the connecting bar are damaged, the blades and the connecting bar can be reassembled.

9 Claims, 6 Drawing Sheets

AIR-FLOW DIRECTION-CONTROL APPARATUS OF A WINDOW TYPE AIR CONDITIONER

BACKGROUND OF THE INVENTION

1. Field of the Invention

The present invention relates to an air conditioner which can control a flow direction of air being discharged into a room, and more particularly to an air-flow direction-control apparatus of a window-type air conditioner in which a plurality of blades for controlling an air-flow direction and a connecting bar which connects the blades can be reassembled.

2. Description of the Prior Art

Generally, an air conditioner lowers a room temperature by sequentially carrying out the cycles of a compression, a condensation, an expansion, and an evaporation of a refrigerant. A window-type air conditioner includes a housing in which an outdoor unit receiving a compressor and a condenser therein and an indoor unit receiving a capillary and an evaporator therein are housed together.

U.S. Pat. No. 5,676,438 discloses a conventional window-type air conditioner. FIG. 1 is a perspective view of an exterior of a conventional window-type air conditioner.

Referring to FIG. 1, a front panel 11 is assembled to a front opened portion(not shown) of a housing 10 receiving various components therein. Inside of housing 10, an indoor unit in which an indoor air circulates and an outdoor unit in which an outdoor air circulates are located. Front panel 11 is formed with an inlet portion 11*a* for introducing the indoor air into the indoor unit and an outlet portion 11*b* for allowing the drawn air to be discharged into the room. The air drawn into the indoor unit is circulated by a fan (not shown) and is chilled by an evaporator (not shown). Reference numeral 12 indicates an inlet portion for drawing the outdoor air.

In the conventional window type air conditioner as above described, the air is discharged from the indoor unit in a fixed direction. That is, there is no means for controlling the direction of the air being discharged through the outlet portion formed at the front panel. So, the room is not uniformly conditioned.

SUMMARY OF THE INVENTION

The present invention is intended to overcome the above-described disadvantages. Therefore, it is a first object of the present invention to provide an air conditioner in which an air-flow direction-control apparatus is installed at an outlet portion so that an inside of a room is uniformly conditioned.

It is a second object of the present invention to provide an air conditioner in which a plurality of blades which controls the air-flow direction and a connecting bar for moving the blades can be reassembled to each other even when connection portions between the connecting bar and the blades are damaged.

In order to achieve the above objects of the present invention, there is provided a window-type air conditioner which comprising:

a housing partitioned into an indoor unit for circulating an indoor air therein and an outdoor unit for circulating an outdoor air therein;

a front panel assembled to the housing, the front panel being formed with an inlet portion for introducing the indoor air into the indoor unit and an outlet portion for allowing air drawn into the indoor unit to be discharged therethrough;

a frame surrounding the outlet portion and isolating the outlet portion from the inlet portion such that the air drawn into the indoor unit circulates in the indoor unit and is discharged through the outlet portion; and a means for controlling a direction of an air flow being discharged through the outlet portion, the means being installed to the frame.

The controlling means includes a plurality of blades rotatably installed at the frame for controlling the air flow-direction, a connecting bar for connecting the blades in such a manner that the blades rotate together, a control bar which extends outwardly from one of the blades so as to be protruded out of the housing for rotating the blades, and stoppers for maintaining the blades at a rotated position by making contact with the frame.

According to a preferred embodiment of the present invention, each of the blades is formed at upper and lower end thereof with assembling rods respectively, and the frame is formed at positions thereof corresponding to positions of the assembling rods with grooves for separably and rotatably receiving the assembling rods.

According to a preferred embodiment of the present invention, a support ring is disposed around each of the assembling rod for preventing the blades from making contact with the frame so that the blades rotate smoothly with respect to the frame.

A plurality of horizontal bars for dividing the outlet portion into plural horizontal portions and a plurality of vertical bars for supporting the horizontal bars are assembled to the frame, each of the blades being formed with concave portions into which the horizontal bars are inserted, the blades being protruded out of the housing by a predetermined length when the blades are assembled to the horizontal bars so as to finely adjust the direction of the air flow being discharged through the outlet portion.

Each of the stoppers extends downwardly from the lower end of each of the blade, is flexible, and the frame is formed with a plurality of grooves along an orbit of each of the stopper for receiving an end portion of the stopper therein so as to maintain the blades in the rotated position.

According to a preferred embodiment of the present invention, hinge bars are formed between the blades and the connecting bar, the blades, the connecting bar and the hinge bars being integrally extruded.

According to a preferred embodiment of the present invention, a reassembling means for reassembling the blades and the connecting bar when the hinge bars are damaged is provided at the blades and the connecting bar.

The reassembling means includes arrow shaped projections formed at the blades and a plurality of holes formed at the connecting bar for receiving the arrow shaped projections therein.

As described above, the window-type air conditioner in accordance with a preferred embodiment of the present invention can adjust the flow direction of the air discharged from the air conditioner, thereby uniformly conditioning the inside of a room.

In addition, even if the hinge bars which connect the blades and the connecting bar are damaged, the blades and the connecting bar can be reassembled.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, an air-flow direction-control apparatus of a window-type air conditioner in accordance with a preferred embodiment of the present invention will be explained in more detail with reference to the accompanying drawings.

Figure 1:
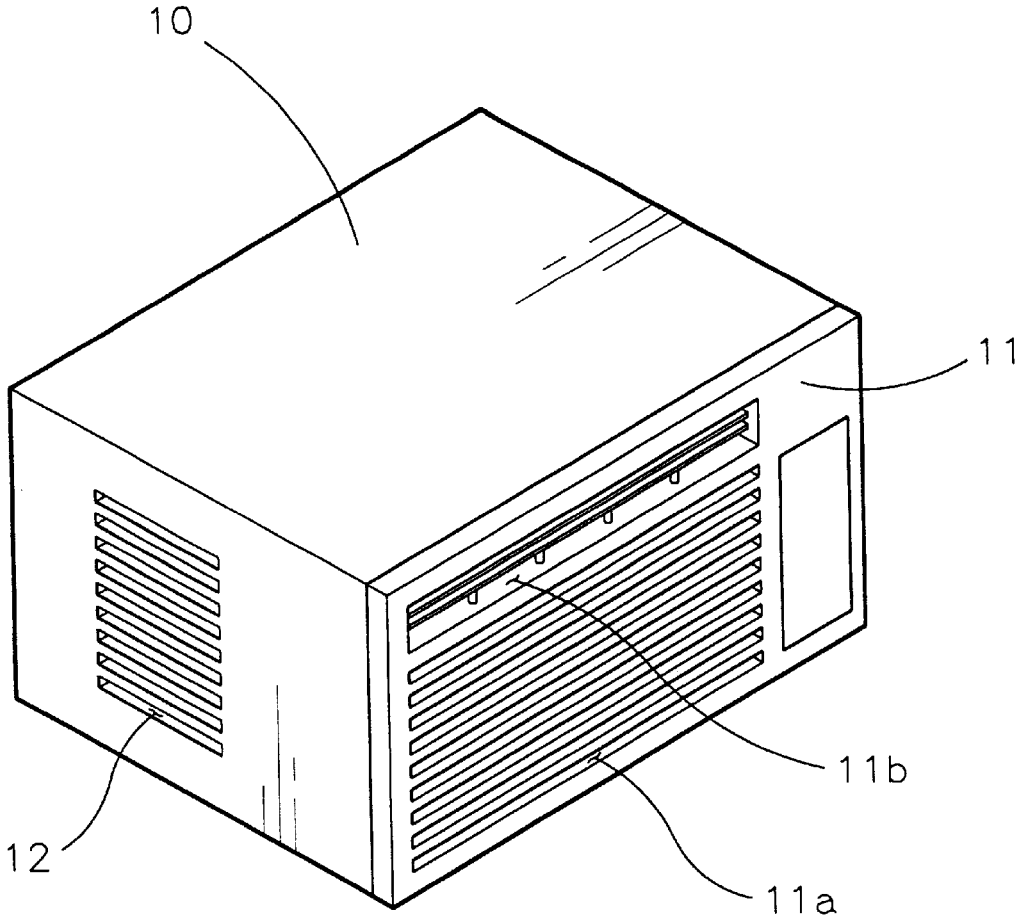
FIG. 1 (PRIOR ART)
FIG. 1 is a perspective view of the exterior of a conventional window-type air conditioner.
Figure 2:
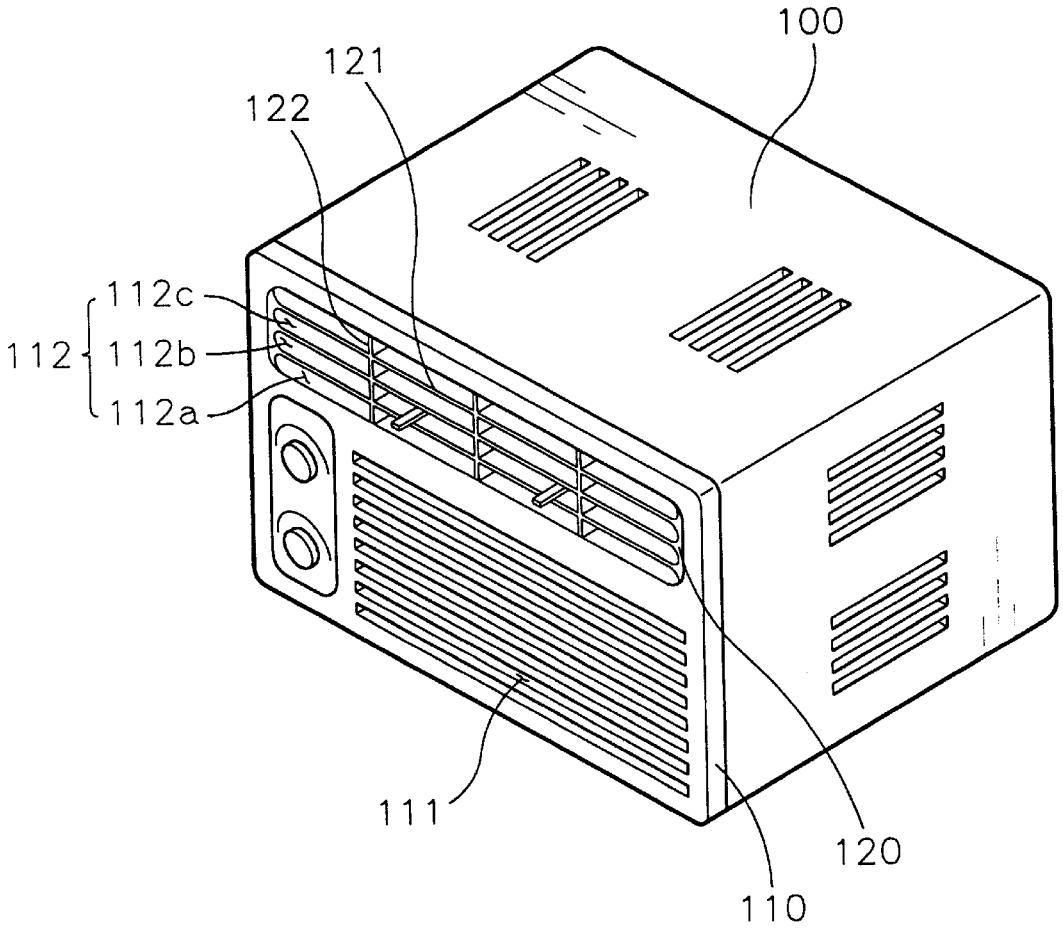
FIG. 2 is a perspective view of a window-type air conditioner in accordance with one embodiment of the present invention.

FIG. 2 is a perspective view of a window-type air conditioner in accordance with an embodiment of the present invention.

Referring to FIG. 2, a housing 100 is partitioned into an indoor unit (not shown) for circulating the indoor air therein and an outdoor unit (not shown) for circulating the outdoor air therein. At the front portion of housing 100, a front panel 110 which is formed with an inlet portion 111 for introducing the indoor air into housing 100 and an outlet portion 112 for discharging the drawn air into a room is assembled. The drawn air is circulated by a fan (not shown).

Outlet portion 112 is surrounded by a frame 120 so as to be isolated from inlet portion 111. That is, the frame 120 guides the air drawn through inlet portion 111 to circulate along the inside of the indoor unit and to be discharged through outlet portion 112. A plurality of horizontal bars 121 to divide outlet portion 112 into plural horizontal portions 112*a*, 112*b*, 112*c*, and a plurality of vertical bars 122 to support horizontal bars 121 are assembled to frame 120.

Figure 3:
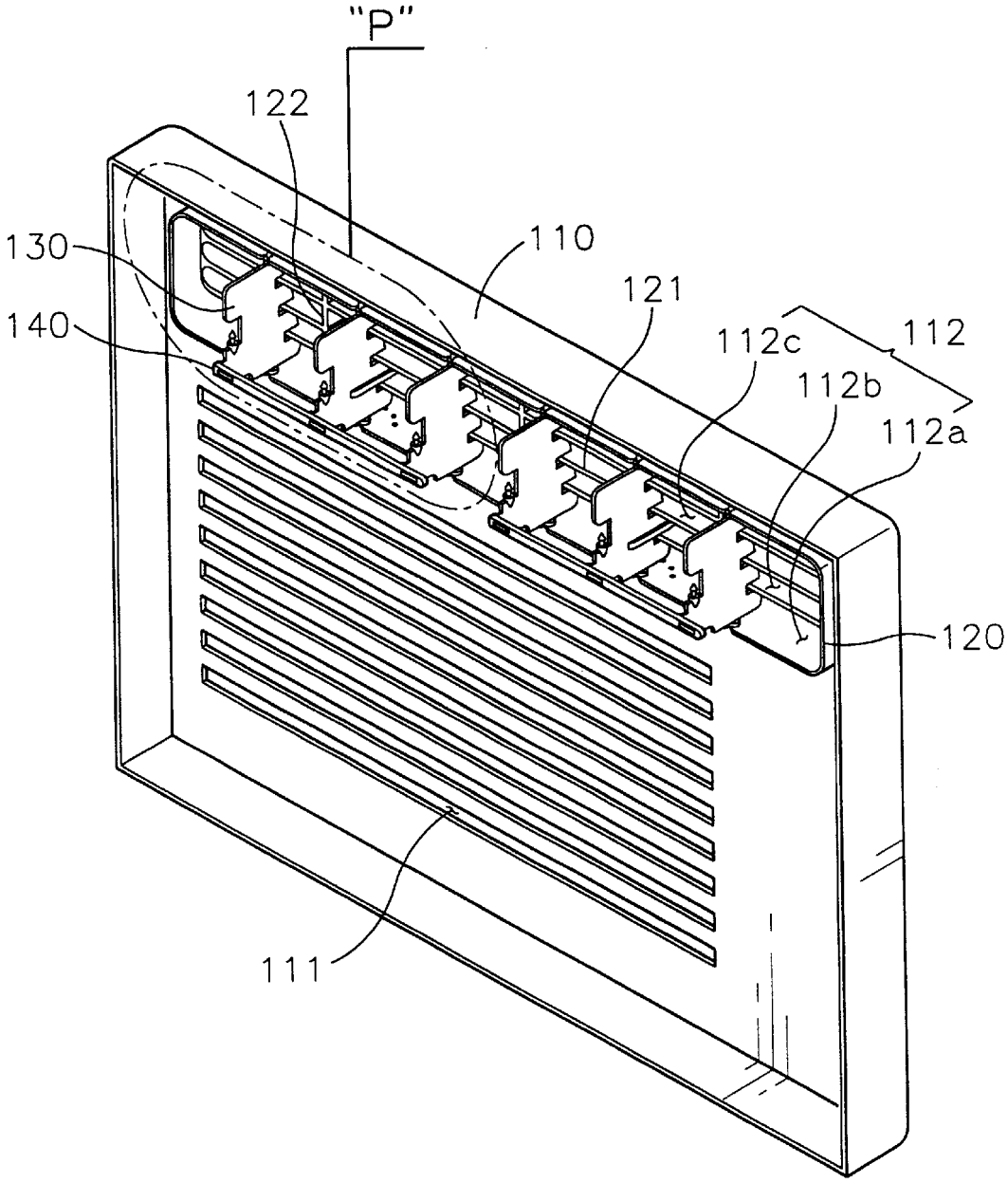
FIG. 3 is a perspective view of a rear portion of a front panel in accordance with a preferred embodiment of the present invention.

The window-type air conditioner in accordance with this embodiment can adjust the flow direction of the air being discharged through outlet portion 112. FIG. 3 is a perspective view of a rear portion of the front panel in accordance with a preferred embodiment of the present invention and FIG. 4 is an exploded perspective view of "P" portion shown in FIG. 3.

Figure 4:
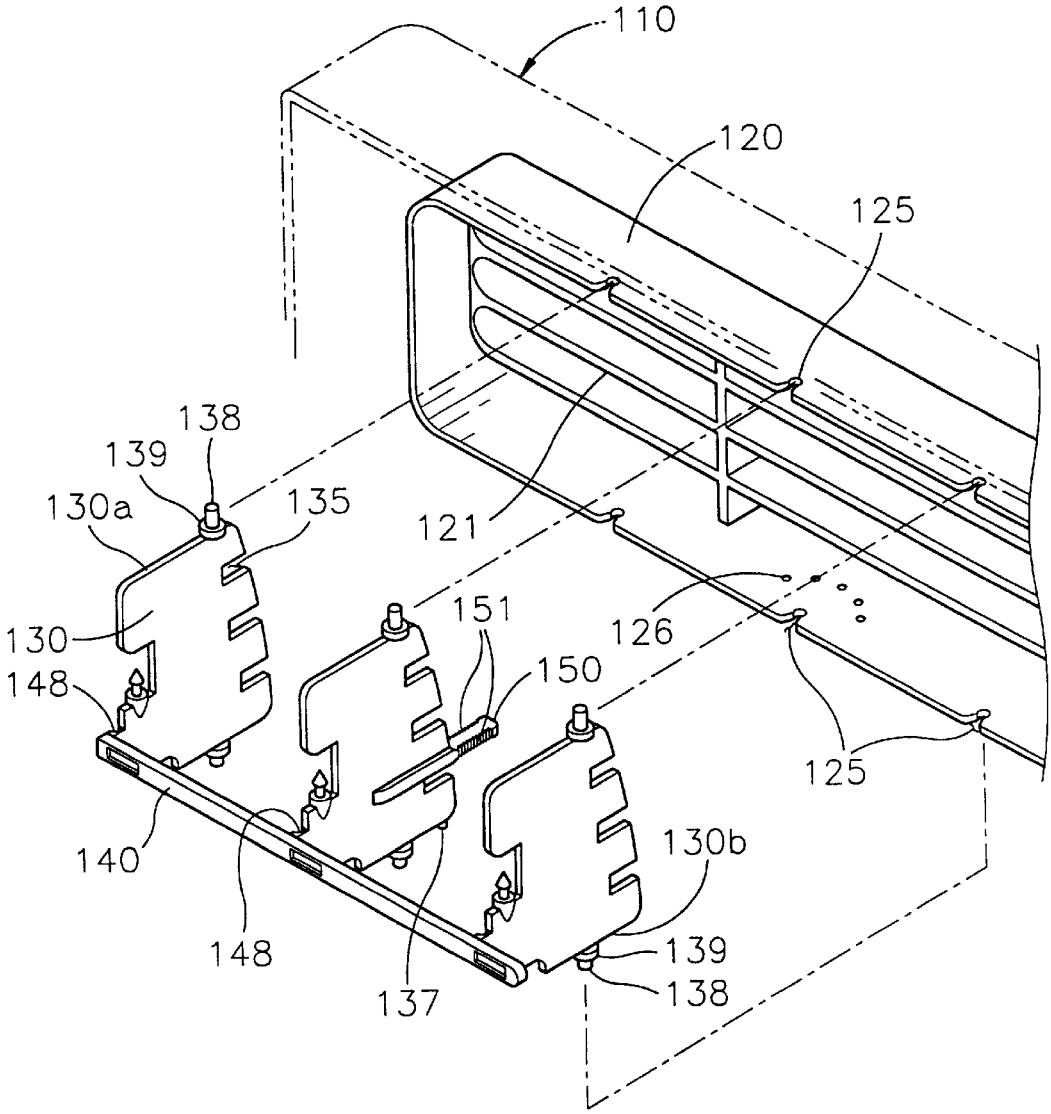
FIG. 4 is an exploded perspective view of "P" portion shown in FIG. 3.

Referring to FIGS. 3 and 4, a plurality of blades 130 are rotatably installed to frame 120 and are connected together by a connecting bar 140. In detail, between blades 130 and connecting bar 140, hinge bars 148 are formed, and all of blades 130, connecting bar 140, and hinge bars 148 are integrally extruded.

A control bar 150 extends from one of either blades 130 for rotating blade 130 by moving control bar 150 from outside of housing 100. When a user pivots control bar 150, blades 130 are rotated together by connecting bar 140 so that the air flow direction is adjusted thereby. To make certain of the pivoting of control bar 150 by the user, control bar 150 is formed at an outward end portion thereof with a scratch portion 151.

Assembling rods 138 extend outwardly from upper and lower ends of blades 130, and frame 120 is formed with grooves 125 corresponding to assembling rods 138 for separably and rotatably receiving assembling rods 138 thereinto. Thus, by pivoting control bar 150, blades 130 are rotated. A couple of support rings 139 are disposed around each couple of assembling rods 138 for preventing upper and lower surfaces 130a and 130b of each blade 130 from contacting frame 120 so that blades 130 rotate smoothly.

A flexible stopper 137 which makes contact with frame 120 and has an elasticity is formed at the lower surface 130*b* of each blade 130 for maintaining the blade 130 at the rotated position. In detail, even if a force is removed from blades 130 after urging blade 130 to rotate a predetermined angle by applying the force to blades 130, blades 130 maintain their rotated position by a frictional force between flexible stoppers 137 and frame 120. For this purpose, frame 120 is formed with a plurality of holes 126 along the orbit of flexible stoppers 137 for receiving flexible stoppers 137. Flexible stoppers 137 together with holes 126 maintain blades 130 in the rotated position.

Blades 130 are formed at positions thereof corresponding to positions of horizontal bars 121 with concave portions 135 for being engaged with horizontal bars 121. In a state where concave portions 135 of blades 130 are inserted around horizontal bars 121, blades 130 are protruded out of housing 100 by a predetermined length thereof so as to more finely adjust the air flow direction in the view of a comparison with a state where blades 130 are not protruded.

Figure 5A:
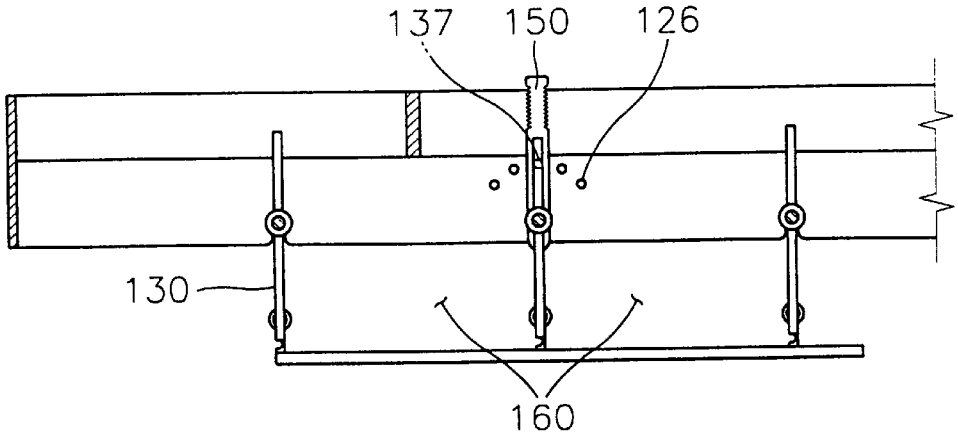
FIGS. 5A to 5C are plan views of a blade portion for illustrating the operation of an air-flow direction-control apparatus in accordance with a preferred embodiment of the present invention.
Figure 5B:
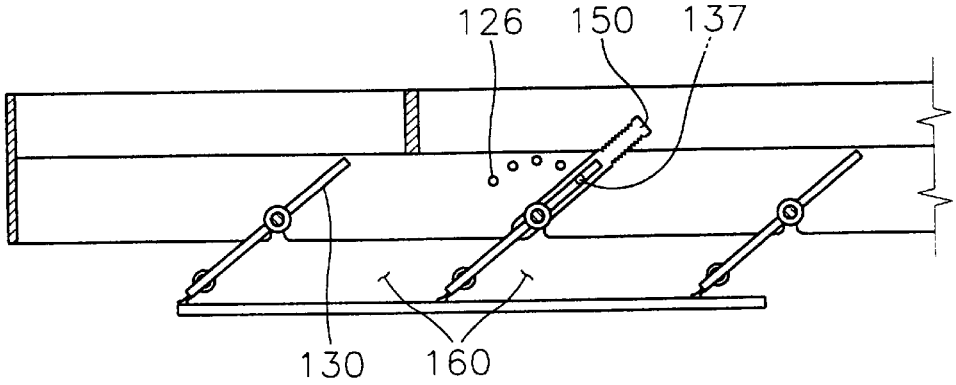
Figure 5C:
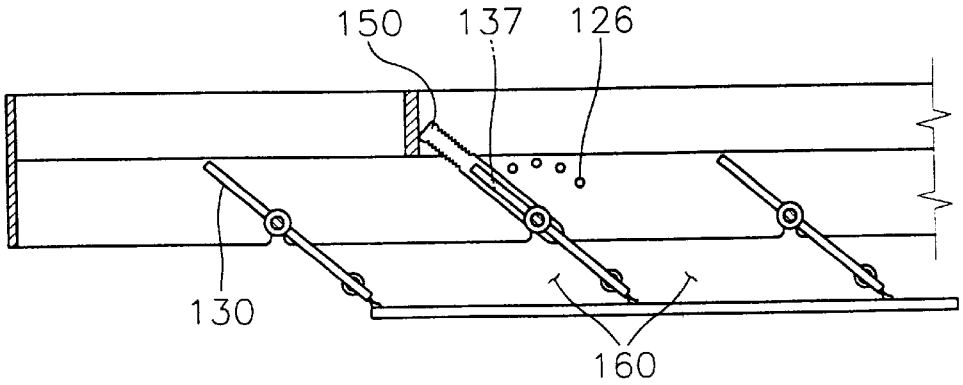

Hereinafter, the operation of the air-flow direction-control apparatus in accordance with a preferred embodiment of the present invention will be described with reference to FIGS. 5A to 5C. FIGS. 5A to 5C are plan views of a blade portion for illustrating the operation of an air-flow direction-control apparatus.

In the state as in FIG. 5A, when the user pivots control bar 150 in a left direction as in FIG. 5B, an air passage 160 formed by blades 130 is directed to the right with respect to a front direction, and when the user pivots control bar 150 in a left direction as in FIG. 5C, an air passage 160 formed by blades 130 is directed to the right with respect to the front direction. As described above, by the rotation of blades 130, the air-flow direction is adjusted. At this time, blades 130 are maintained at the rotated position by flexible stoppers 137 and holes 126.

When control bar 150 is pivoted in the left or right direction, blades 130 are rotated together by connecting bar 140. After repetitive operations of blades 130, hinge bars 148 connecting blades 130 with connecting bar 140 can be damaged. Even in this case, the air-flow control apparatus in accordance with a preferred embodiment of the present invention can reassemble blades 130 and connecting bar 140.

Figure 6A:
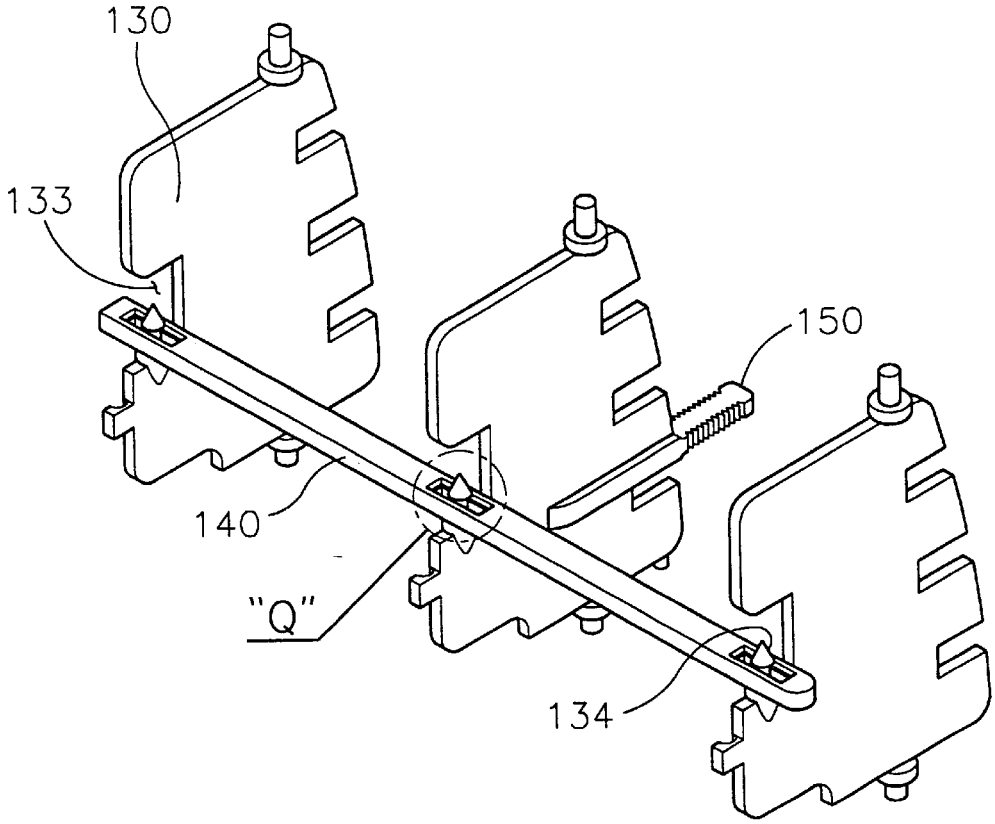
FIG. 6A is a perspective view of a reassembled state of blades and a connecting bar in accordance with a preferred embodiment of the present invention.
Figure 6B:
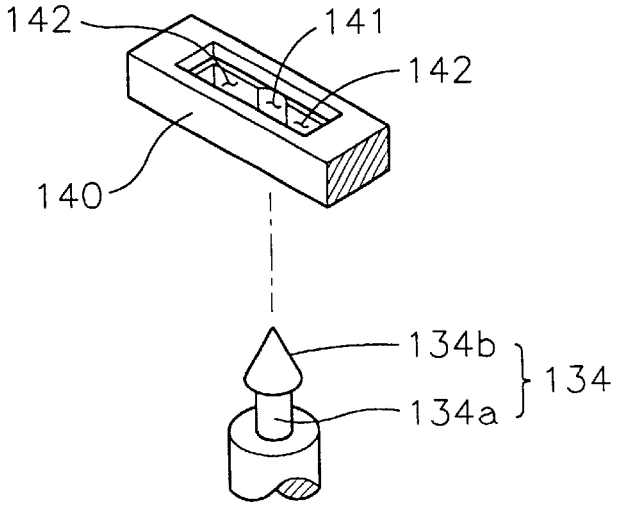
FIG. 6B is an enlarged exploded perspective view of a portion "Q" shown in FIG. 6A.

FIG. 6A is a perspective view of a reassembled state of the blades and connecting bar in accordance with a preferred embodiment of the present invention, and FIG. 6B is an enlarged exploded perspective view of a portion "Q" shown in FIG. 6A.

Blades 130 are formed at the inner side portion thereof with recesses 133. An arrow shaped projection 134 is formed at a bottom of each recess 133. Each arrow shaped projection 134 includes a first body 134*a* and a second body 134*b* which extends upwardly from first body 134*a* and has a larger diameter than that of first body 134*a*.

Connecting bar 140 is formed with holes 141 through which arrow shaped projections 134 are inserted and is formed with notch portions 142 communicated with holes 141. A pair of notch portions 142 is formed at both sides of each of the holes 141 so as to allow hole 141 to widen or narrow.

To assembling connecting bar 140 to blades 130, the user disposes holes 141 of connecting bar 140 on second bodies 134*b* of arrow shaped projections 134, and then pushes connecting bar 140. Then, holes 141 are widen along notch portions 142. Thus, arrow shaped projections 134 are press-fitted into holes 141. That is, second bodies 134*b* of arrow shaped projections 134 are inserted into corresponding holes 141 and prevent arrow shaped projections 134 from being escaped therefrom. Therefore, blades 130 and connecting bar 140 are reassembled. Also, as aforementioned, blades 130 rotate together by a pivot of control bar 150.

As described above, the window-type air conditioner in accordance with a preferred embodiment of the present invention can adjust the flow direction of the air discharged from the air conditioner, thereby uniformly conditioning the inside of a room.

In addition, even if the hinge bars which connect the blades and the connecting bar are damaged, the blades and the connecting bar can be reassembled.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A window-type air conditioner, comprising:

a housing partitioned into an indoor unit for circulating an indoor air therein and an outdoor unit for circulating an outdoor air therein;

a front panel assembled to the housing, the front panel being formed with an inlet portion for introducing the indoor air into the indoor unit and an outlet portion for allowing air drawn into the indoor unit to be discharged therethrough;

a frame surrounding the outlet portion and isolating the outlet portion from the inlet portion such that the air drawn into the indoor unit circulates in the indoor unit and is discharged through the outlet portion; and a means for controlling a direction of an air flow being discharged through the outlet portion, the means being installed to the frame, wherein the means includes a plurality of blades rotatably installed at the frame for controlling the air flow direction a connecting bar for connecting the blades in such a manner that the blades rotate together a control bar which extends outwardly from one of the blades so as to be protruded out of the housing for rotating the blades and stoppers for maintaining the blades at a rotated position by making contact with the frame, hinge bars being formed between the blades and the connecting bar, the blades, the connecting bar, and the hinge bars being integrally extruded, a reassembling means for reassembling the blades and the connecting bar when the hinge bars are damaged being provided to the blades and the connecting bar, the reassembling means including arrow shaped projections formed at the blades and a plurality of holes formed at the connecting bar for receiving the arrow shaped projections therein.

2. The window-type air conditioner as recited in claim 1, wherein each of the blades is formed at upper and lower end thereof with assembling rods respectively, and the frame is formed at positions thereof corresponding to positions of the assembling rods with grooves for separably and rotatably receiving the assembling rods.

3. The window-type air conditioner as recited in claim 2, wherein a support ring is disposed around each of the assembling rods for preventing the blades from making contact with the frame so that the blades rotate smoothly with respect to the frame.

4. The window-type air conditioner as recited in claim 1, wherein a plurality of horizontal bars for dividing the outlet portion into plural horizontal portions and a plurality of vertical bars for supporting the horizontal bars are assembled to the frame, each of the blades being formed with concave portions into which the horizontal bars are inserted, the blades being protruded out of the housing by a predetermined length when the blades are assembled to the horizontal bars so as to finely adjust the direction of the air flow being discharged through the outlet portion.

5. The window-type air conditioner as recited in claim 1, wherein each of the stoppers extends downwardly from the lower end of each of the blade and is flexible, and the frame is formed with a plurality of grooves along an orbit of each of the stopper for receiving an end portion of the stopper therein so as to maintain the blades in the rotated position.

6. A window-type air conditioner, comprising:

a housing partitioned into an indoor unit for circulating an indoor air therein and an outdoor unit for circulating an outdoor air therein;

a front panel assembled to the housing, the front panel being formed with an inlet portion for introducing the indoor air into the indoor unit and an outlet portion for allowing air drawn into the indoor unit to be discharged therethrough;

a frame surrounding the outlet portion and isolating the outlet portion from the inlet portion such that the air drawn into the indoor unit circulates in the indoor unit and is discharged through the outlet portion;

a plurality of horizontal bars assembled to the frame for dividing the outlet portion into plural horizontal portions;

a plurality of vertical bars for supporting the horizontal bars;

a plurality of blades rotatably installed at the frame for controlling the air-flow direction;

a connecting bar for connecting the blades in such a manner that the blades rotate together;

hinge bars formed between the blades and the connecting bar;

a control bar which extends outwardly from one of the blades so as to be protruded out of the housing for rotating the blades;

stoppers for maintaining the blades at a rotated position by making contact with the frame;

a couple of assembling rods extending from upper and lower ends of each of the blades, the assembling rods being separably and rotatably inserted into grooves formed at the frame; and a support ring being disposed around each of the assembling rods for preventing the blades from making contact with the frame so that the blades rotate smoothly with respect to the frame, wherein a reassembling means for reassembling the blades and the connecting bar when the hinge bars are damaged is provided at the blades and the connecting bar, and the reassembling means includes arrow shaped projections formed at the blades and a plurality of holes formed at the connecting bar for receiving the arrow shaped projections therein.

7. The window-type air conditioner as recited in claim 6, wherein each of the blades being formed with concave portions into which the horizontal bars are inserted, the blades being protruded out of the housing at a predetermined length when the blades are assembled to the horizontal bars so as to finely adjust the direction of the air flow being discharged through the outlet portion.

8. The window-type air conditioner as recited in claim 6, wherein each of the stoppers extends downwardly from the lower end of each of the blade, is flexible, and the frame is formed with a plurality of grooves along an orbit of each of the stoppers for receiving an end portion of the stopper therein so as to maintain the blades in the rotated position.

9. The window-type air conditioner as recited in claim 6, wherein the blades, the connecting bar and the hinge bars are integrally extruded.

* * * * *